US006519920B1

(12) United States Patent
Shinbashi

(10) Patent No.: US 6,519,920 B1
(45) Date of Patent: Feb. 18, 2003

(54) COIN WRAPPING MACHINE AND METHOD

(75) Inventor: Shinichiro Shinbashi, Tokyo (JP)

(73) Assignee: Laurel Bank Machines Co., Ltd., Tokyo (JP)

( * ) Notice: Subject to any disclaimer, the term of this patent is extended or adjusted under 35 U.S.C. 154(b) by 99 days.

(21) Appl. No.: 09/716,995

(22) Filed: Nov. 22, 2000

(30) Foreign Application Priority Data

Nov. 25, 1999 (JP) ..... 11-335038

(51) Int. Cl.[7] ..... B65B 57/00; B65B 11/58; B65B 11/04

(52) U.S. Cl. ..... 53/465; 53/53; 53/65; 53/212

(58) Field of Search ..... 53/212, 53, 52, 53/65, 532, 443, 465, 494, 55, 74

(56) References Cited

U.S. PATENT DOCUMENTS 4,869,029 A * 9/1989 Takatani et al. ..... 414/795
4,979,357 A 12/1990 Miyamoto
5,105,601 A * 4/1992 Horiguchi et al. ..... 53/212
5,499,483 A * 3/1996 Oikawa ..... 53/212
5,970,683 A * 10/1999 Miyamoto et al. ..... 53/201
6,209,294 B1 * 4/2001 Hibari ..... 453/31

FOREIGN PATENT DOCUMENTS

| | | |
|---|---|---|
| EP | 0 660 278 | 7/1997 |
| JP | 3-612 | 1/1991 |

* cited by examiner

*Primary Examiner*—Rinaldi I. Rada
*Assistant Examiner*—Paul Durand
(74) *Attorney, Agent, or Firm*—Nixon & Vanderhye PC

(57) ABSTRACT

The coin wrapping machine of the present invention comprises a coin feeding device for feeding a plurality of coins one by one; a stacking device for stacking the fed coins; a wrapping paper winding and clamping device for performing a wrapping operation to produce wrapped stacks of coins by winding a wrapping paper around the circumference of the stacked coins, and clamping the wrapping paper by a pair of upper and lower clamping nails by moving the respective nails upwardly and downwardly; an insufficient/excess number detecting device for detecting an insufficient or excess number of the wrapped stack of coins; and a wrapping paper multiple winding control device for directing the wrapping paper winding and clamping device to perform the wrapping operation twice or more for the wrapped stack of coins when the insufficient or excess number of coins is detected by an insufficient/excess number detecting device.

8 Claims, 6 Drawing Sheets

COIN WRAPPING MACHINE AND METHOD

BACKGROUND OF THE INVENTION

1. Field of the Invention

The present invention relates to a coin wrapping machine and method adapted to stack a predetermined number of inserted coins and to wrap the stacked coins, while detecting the wrapped stack of coins with an insufficient or excess number of coins in the wrapping section.

2. Description of the Related Art

A device for detecting s an insufficient/excess number coins wrapped by a coin wrapping section is disclosed, for example, in Japanese Patent Application, First Publication No. 3-612.

The device wraps coins by feeding stacked coins into the wrapping section, then feeding wrapping paper, moving upper and lower clamping nails so as to clamp the upper and lower ends of the wrapping paper. The height of the stacked coins is measured, based on the upper and lower clamping nails abutting against the upper and lower ends of the stacked coins. That is, an insufficient or excess number of coins in the wrapped stack of coins is detected by detecting the amount of movement of the upper and lower clamping nails as absolute position data with a rotary encoder, calculating the height of the stacked coins from the detected absolute position data, calculating the difference between the height of the stacked coins calculated from the absolute position data by the rotary encoder and a predetermined reference data by a comparison device, and determining whether the calculated value is in an allowable range.

However, according to the above method for detecting the number of coins, based on the amount of movement of the clamping nails, even when the number of the coins is insufficient, the stacked coins are wrapped. That is, stacks of coins with an insufficient or excess number of coins are wrapped as well as the stacked coins with the normal number of coins. Therefore, there is the problem that, when the wrapped stacks of coins with an insufficient or excess number of coins are mixed with the wrapped stacks of coins having the desired number of coins, the wrapped stacks of coins with an insufficient or excess number of coins cannot be distinguished from the others.

SUMMARY OF THE INVENTION

The object of the present invention is to provide a coin wrapping machine which visually distinguishes wrapped stacks of coins with an insufficient or excess number of coins from wrapped stacks of coins with the correct number of coins.

In a first aspect of the present invention, the coin wrapping machine comprises: a coin feeding device for feeding a plurality of coins one by one; a stacking device for stacking the fed coins; a wrapping paper winding and clamping device for performing a wrapping operation to produce a wrapped stack of coins by winding a wrapping paper around the circumference of the stacked coins, and clamping the wrapping paper by a pair of upper and lower clamping nails by moving the respective nails upwardly and downwardly; an insufficient/excess number detecting device for detecting an insufficient or excess number of the wrapped stack of coins; and a wrapping paper multiple winding control device for directing the wrapping paper winding and clamping device to perform the wrapping operation twice or more for the wrapped stack of coins when an insufficient or excess number of coins is detected by the insufficient/excess number detecting device.

When an insufficient or excess number of coins is detected by the insufficient/excess number detecting device, the wrapping paper multiple winding control device directs the wrapping paper winding and clamping device to perform the wrapping operation twice or more for the wrapped stack of coins. The wrapped stacks of coins with the insufficient or excess number of coins can be visually distinguished from the normally wrapped stack of coins.

In a second aspect of the present invention, the wrapping paper multiple winding control device produces an incomplete clamped portion by decreasing the distance of movement of the clamping (crimping) nails in the second and subsequent wrapping operations from that in the first wrapping operation.

When an insufficient or excess number of coins is detected by the insufficient/excess number detecting device, the wrapping paper multiple winding control device directs the wrapping paper winding and clamping device to perform the wrapping operation twice or more for the wrapped stack of coins. In the second and subsequent wrapping operations, the distance of movement of the upper clamping nail 18 is shorter than that in the first wrapping operation. Therefore, the clamping action is stopped incompletely so that an incompletely clamped portion is intentionally produced at the clamped edge portions of doubly or more wrapped stack of coins. Accordingly, the wrapped stack of coins with an insufficient or excess number of coins can be visually distinguished from the normally wrapped stack of coins by the condition of the wrapping paper which has been incompletely clamped and has been wrapped more times than usual.

In a third aspect of the present invention, the wrapping paper multiple winding control device has a limiting device for limiting the movement of at least one of the upper and lower clamping nails in the second and subsequent wrapping operations to be shorter than that in the first wrapping operation.

The limiting device limits the distance of movement of the upper or lower clamping nail to be shorter than that in the first wrapping operation. Therefore, the clamping action is stopped incompletely, and a distinct incompletely clamped portion can be produced at the upper or lower clamped portion of the doubly or more wrapped stack of coins.

In a fourth aspect of the present invention, the wrapping paper multiple winding control device has a limiting device for limiting the movements of both the upper and lower clamping nails in the second and subsequent wrapping operations to be shorter than that in the first wrapping operation.

The limiting device limits the distance of movements of the upper and lower clamping nails to be shorter than that in the first wrapping operation. Therefore, the clamping action is stopped incompletely, and a distinct incompletely clamped portions can be produced at both ends of the coins wrapped twice or more.

BRIEF DESCRIPTION OF DRAWINGS

FIG. 5B shows an abnormal wrapped stack of coins with an insufficient or excess number of coins.

FIGS. 6A and 6*b* show wrapped stacks of coins with an insufficient or excess number of coins, produced by the coin wrapping machine of other embodiments of the present invention, the wrapped stack of coins having an insufficient or excess number of coins.

DESCRIPTION OF THE PREFERRED EMBODIMENTS

The coin wrapping machine according to the embodiments of the present invention will be described below with reference to FIGS. 1 to 6.

First, the basic configuration of the coin wrapping machine according to the embodiment will be described with reference to FIGS. 1 to 3.

Figure 1:
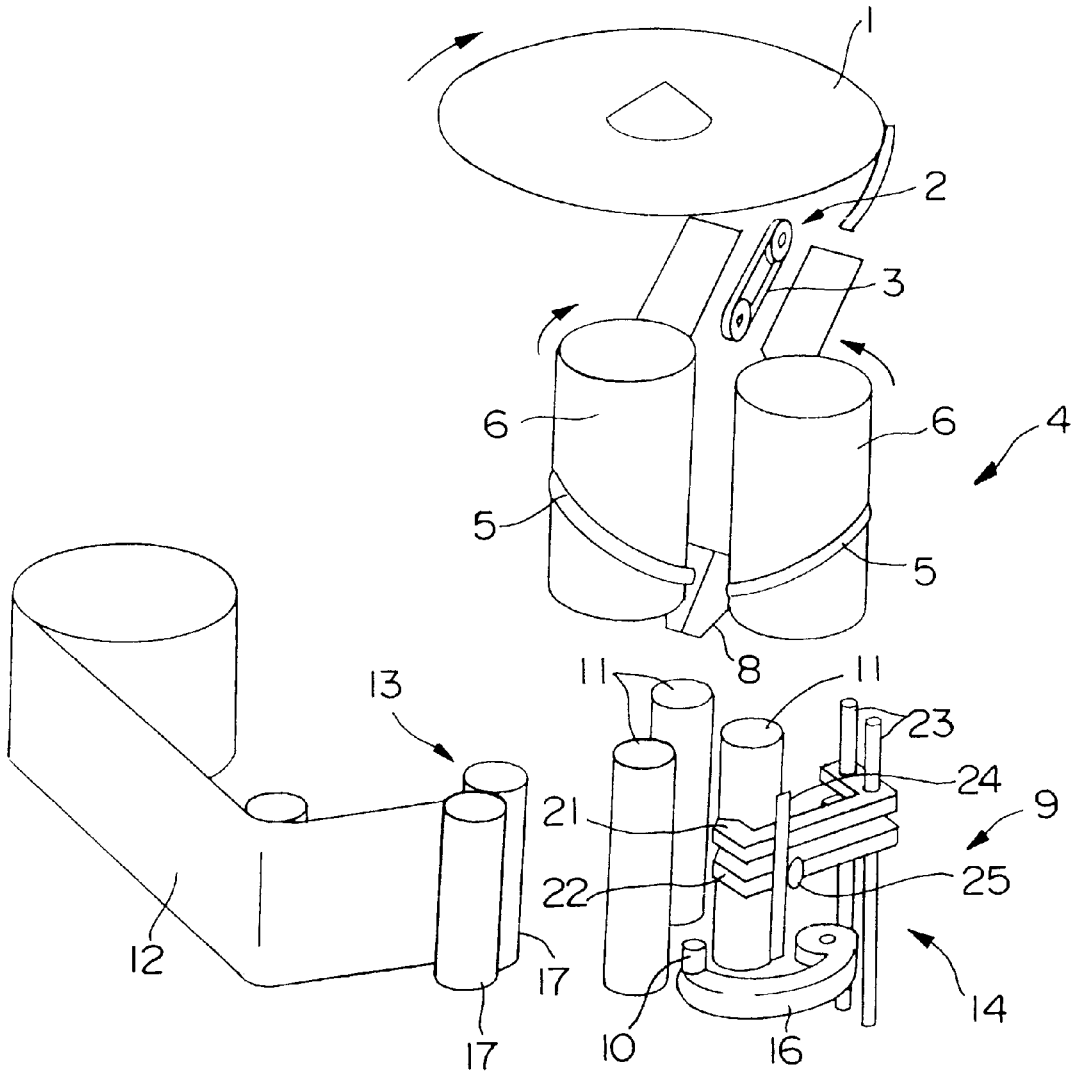
FIG. 1 is a perspective view showing the entire schematic configuration of the coin wrapping machine according to the embodiment of the present invention.

In FIG. 1, reference numeral 1 denotes a rotary disc (coin feeding device) onto which coins are dropped together. The coins on the rotary disc 1 are fed one by one into a horizontal coin path 2 (coin feeding device) by the centrifugal force of the rotary disc 1.

The coin path 2 has a feed belt 3 (coin feeding device) for feeding coins one by one to an upper position. A coin determination section, not shown, is provided at the midpoint of the coin path 2, and determines whether the coin is genuine or not, and its denomination.

The coins which have passed through the coin path 2 are subsequently supplied to a stacking section 4 (stacking device), and are stacked one by one.

The stacking section 4 comprises a pair of stacking drums 6 having spiral protruding portions 5. The stacking drums 6 are intermittently rotated in the opposite directions to each other, synchronously with the supply of the coins from the coin path 2, while matching the horizontal positions of the protruding portions 5 with each other.

Accordingly, the coins supplied through the coin path 2 are lowered by the protruding portions 5 of the stacking drums 6, and the next supplied coin is stacked on the coin previously supplied. As the result, a plurality of coins are vertically stacked by the stacking drums 6, and the stacks of coins 7 (see FIG. 2) are thus formed.

Further, a shutter 8 for placing a predetermined number of coins (e.g., 50 coins), which have been stacked by the stacking drum 6, on the upper surface of the shutter 8, is provided below the stacking drum 6. When the shutter 8 is opened, the stacked coins 7 placed on the upper surface of the shutter 8 are dropped, and are received by a lower wrapping section 9 (wrapping paper winding and clamping device).

The wrapping section 9 comprises: a supporting rod 10 for supporting the underside of the stacked coins 7 dropped through the shutter 8; a wrapping mechanism 13 for supplying and winding a wrapping paper 12 around the one set of stacked coins 7 by three movable parallel wrapping rollers 11 aligned in the vertical direction around the supporting rod 10; and a clamping mechanism 14 for clamping the wound wrapping paper 12 at the upper and lower ends of the stacked coins 7. The wrapping roller 11 is rotated around the center of the axis by a wrapping motor which is not shown. Further, a control device 15 (see FIG. 3), for controlling the operations of these mechanisms, is provided in the wrapping mechanism 13 and clamping mechanism 14.

The supporting rod 10 is fixed onto the end of a vertically-movable supporting rod arm 16, is disposed just below the shutter 8 by operations of a supporting rod arm cam and a supporting rod arm relief cam (which are not shown) when the shutter 8 is opened, receives the falling stacked coins 7 on the upper end of the supporting rod 10, and lowers the stacked coins 7 vertically so that the stacked coins 7 are positioned between the three wrapping rollers 11.

The wrapping mechanism 13 catches the stacked coins 7 with the three wrapping rollers 11 in three radial directions by bringing the wrapping rollers 11 close to each other by means of an opening/closing cam (not shown). Further, wrapping paper feed rollers 17 are provided in the vicinity of the wrapping rollers 11. By means of the wrapping paper feed rollers 17, the wrapping paper 12 is fed between the stacked coins 7 and the wrapping rollers 11. While the wrapping paper 12 is being fed between the stacked coins 7 and the wrapping rollers 11 with the wrapping paper feed rollers 17, the wrapping paper 12 is wound around a cylindrical surface of the set of stacked coins 7 by the rotation of the wrapping rollers 11 by the operation of the wrapping motor.

The wrapping paper 12 is wider than the height of the stacked coins 7.

Figure 2:
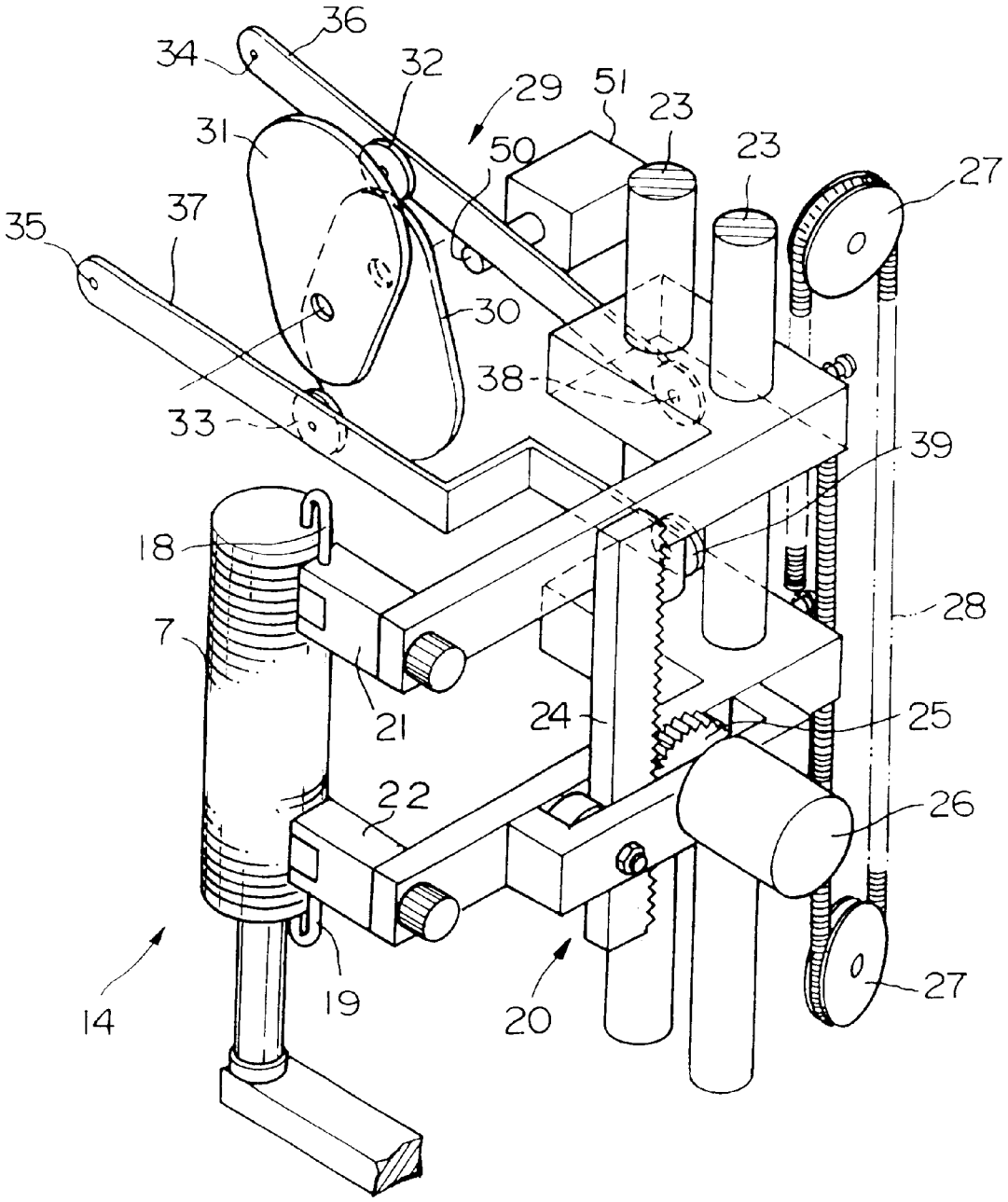
FIG. 2 is a perspective view showing a clamping nail driving mechanism of the coin wrapping machine of FIG. 1.
Figure 3:
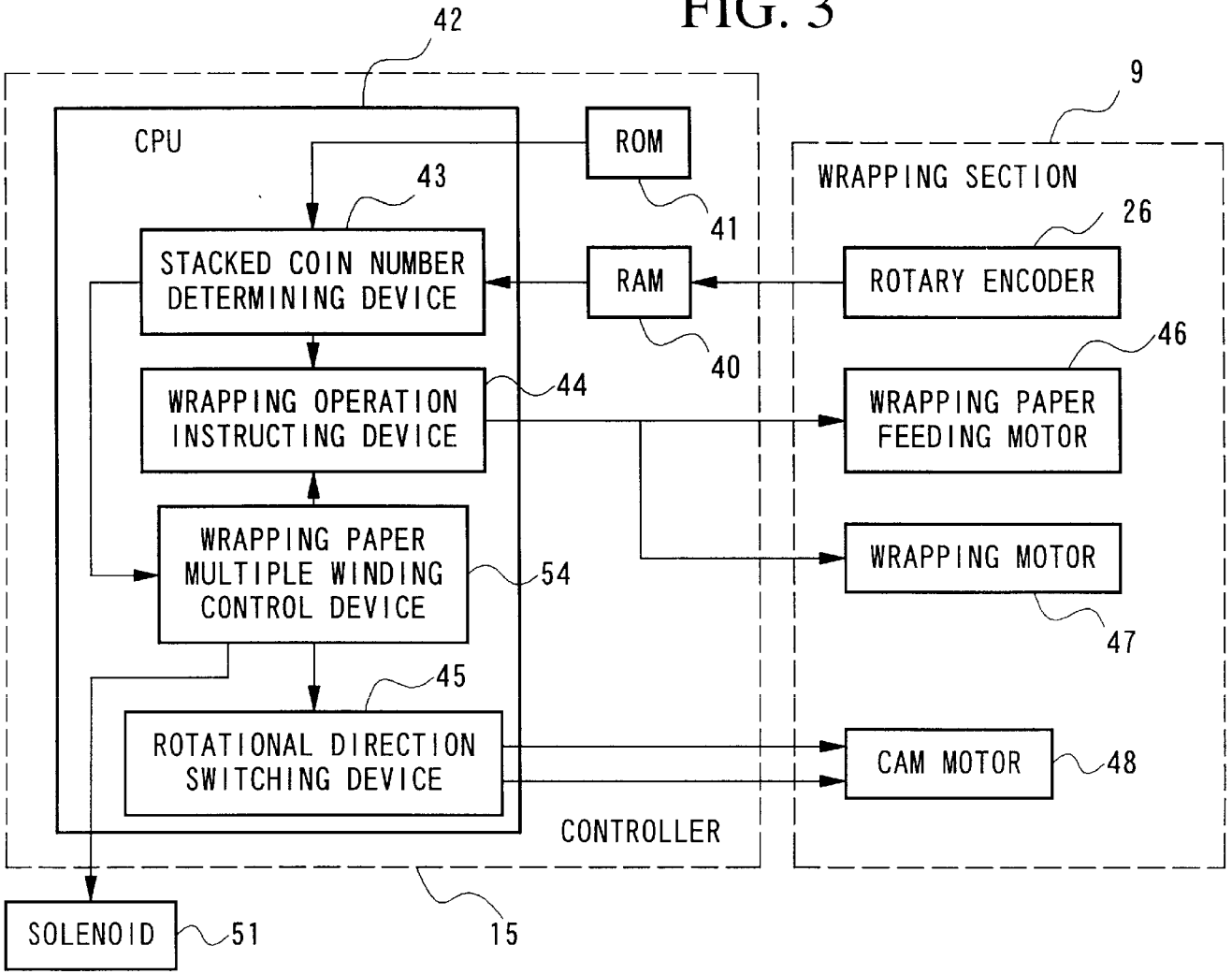
FIG. 3 is a block diagram of the coin wrapping machine of FIG. 1.

As shown in FIG. 2, the clamping (crimping) mechanism 14 comprises: a pair of clamping (crimping) nails 18 and 19 to be positioned on the upper and lower surfaces of the stacked coins 7 through the spaces between the wrapping rollers 11 by the operation of a clamping nail relief cam (not shown) after the stacked coins 7 have been disposed between the wrapping rollers 11 (omitted in FIG. 2); and a clamping nail driving mechanism 20 for moving up or down the clamping nails 18 and 19 so as to come close to and separate from each other.

The clamping nail driving mechanism 20 includes an upper arm 21 which secures the upper clamping nail 18, a lower arm 22 which secures the lower clamping nail 19, a guide rod 23 which supports these upper and lower arms 21 and 22 movably in the vertical direction, a rack 24 fixed to the upper arm 21, a pinion 25 engaged with the rack 24 and rotatably supported by the lower arm 22, and an absolute type rotary encoder 26 (insufficient/excess number detecting device) connected to the rotating shaft of the pinion 25.

That is, when the upper and lower arms 21 and 22 are moved along the guide rods 23 to bring the upper and lower clamping nails 18 and 19 towards or away from each other, the rack 24 fixed to the upper arm 21 is moved in the vertical direction. As a result, the pinion 25 engaged with the rack 24 is rotated, and the amount of rotation is measured by the rotary encoder 26. The detected amount of rotation is in direct proportion to the total of the distance moved by the upper and lower clamping nails 18 and 19. Thus, a relative movement of the clamping nails 18 and 19 can be obtained.

Further, the clamping nail driving mechanism 20 includes a spring 28 wound around a pulley 27 and connected to the upper and lower arms 21 and 22. This spring 28 is biased in the direction so that the upper arm 21 and the lower arm 22 are brought close to each other.

Additionally, the clamping nail driving mechanism 20 includes a cam mechanism 29 for bringing the upper and lower arms 21 and 22 close to or away from each other.

The cam mechanism 29 comprises: clamping nail cams 30 and 31, which are rotated in the vertical plane by means of a cam motor, not shown; cam followers 32, 33 which are rolled on the cam surfaces of the clamping nail cams 30 and 31; and upper and lower movable arms 36 and 37, having the rotatable cam followers 32 and 33 at the midpoints in the longitudinal directions of the arms 36 and 37, which are rotatable around the fixed shafts 34 and 35. Rollers 38 and 39, which are rolled on the lower surface of the upper arm 21 and on the upper surface of the lower arm 22, are rotatably attached at the ends of the upper and lower movable arms 36 and 37.

When the cam motor is operated while stacked coins 7 are placed between the wrapping rollers 11, the clamping nail cams 30, 31 are rotated so that the cam followers 32, 33 are moved along the cam surfaces of the clamping nail cams 30 and 31. Accordingly, the upper and lower movable arms 36 and 37, which are connected to the cam followers 32 and 33, are pivotably moved around the fixed shafts 34, 35 in the vertical plane.

Then, when the movable arms 36 and 37 are moved so that the lower surface of the upper arm 21 and the upper surface of the lower arm 22 are pressed with the rollers 38 and 39, the upper arm 21 is moved up, and the lower arm 22 is moved down, so that the clamping nails 18 and 19 are separated from each other against the biasing force of the spring 28 at the ends of the movable arms 36 and 37. When the respective movable arms 36 and 37 are moved in the direction different from those in the above case, the upper arm 21 is moved down, and the lower arm 22 is moved up so that they are brought close to each other by the biasing force of the spring 28.

Thus, the upper clamping nail 18 secured to the upper arm 21 and the lower clamping nail 19 secured to the lower arm 22 are reciprocated between the separated positions where they are separated from the stacked coins 7 in the vertical direction and the contact positions where the nails 18 and 19 are brought into contact with the upper and lower surfaces of the stacked coins 7. The separated positions are fixed uniquely by the cam mechanism 29. The contact positions are changed, depending on the denominations and number of stacked coins 7.

A roll chute (not shown) for receiving the wrapped stacks of coins 7A (see FIG. 5), which are the stacked coins 7 with a normal number of coins wrapped with the wrapping paper 12, a reject box (not shown) for receiving the wrapped stacks of coins 7A having an abnormal number of coins, and a gate (not shown) for dispensing the wrapped stack of coins 7A into the roll chute or the reject box are provided below the wrapping section 9.

A stopper (limiting device) 50 for restricting the pivoting movement of the upper movable arm 36, that is, the lowering movement of the upper clamping nail 18 by abutting the underside of the upper movable arm 36, and a solenoid (limiting device) 51 for making the stopper 50 protrude into the moving range of the upper movable arm 36 and retracting from the upper movable arm 36 are provided in the side of the upper movable arm 36.

That is, when the solenoid 51 is energized, and when the stopper 50 is protruding into the moving range of the upper movable arm 36, the upper clamping nail 18 is lowered to a predetermined stop position where the upper movable arm 36 abuts the stopper 50 so that the movement is limited. On the other hand, when the solenoid 51 is demagnetized, and when the stopper is extracted from the moving range of the upper movable arm 36, the movement of the upper movable arm 36 is not restricted by the stopper 50, whereby the upper clamping nail 18 can be further lowered below the stop position.

Further, the control device 15 comprises a RAM 40 for inputting and outputting the data and the like detected by the rotary encoder 26 of the clamping nail driving mechanism 20, a ROM 41 for storing set data such as the height of stacks of coins having the normal number of coins, and a CPU 42 for processing data stored in the RAM 40 and the ROM 41. The CPU 42 performs the respective functions of a stacked coin number determining device (insufficient/excess number detecting device) 43, a wrapping operation instructing device 44, a rotation direction switching device 45 and a wrapping paper multiple winding control device 54.

The stacked coin number determining device 43 calculates the height of the wrapped stack of coins 7A, based on data of the amount of rotation. The data is associated with the clamping operation of the pinion 25, and is input from the rotary encoder 26 to the RAM 40. The stacked coin number determining device 43 compares the height of the stacked coins with the normal height of stacked coins stored in ROM 41, and determines whether the wrapped stack of coins 7A have an insufficient or excess number of coins.

Specifically, the height of the wrapped stack of coins 7A is obtained by subtracting the distance L2 moved by the upper clamping nail 18 and the lower clamping nail 19 in the clamping operation from the maximum distance L1 between the upper clamping nail 18 and the lower clamping nail 19.

The wrapping operation instructing device 44 outputs an operation instruction or an operation stop instruction to a wrapping paper feeding motor 46 that drives the wrapping paper feed roller 17 and a wrapping motor 47.

The rotation direction switching device 45 switches the direction of rotation of a cam motor 48, based on the determination results of the stacked coin number determining device 43. The cam motor 48 will be described below.

When the stacked coin number determining device 43 detects that the number of coins, which has been calculated from the height of the wrapped stack of coins 7A with an insufficient or excess number of coins, a wrapping paper multiple-winding control device 54 (for winding the wrapping paper a number of times around the coins) directs the wrapping section 9 to feed and wind the wrapping paper 12 once (or a number of times) around the peripheral surface of the wrapped stack of coins 7A, and to clamp the wound wrapping paper 12 by moving the upper and lower clamping nails 18 and 19 in the vertical direction.

Figure 4:
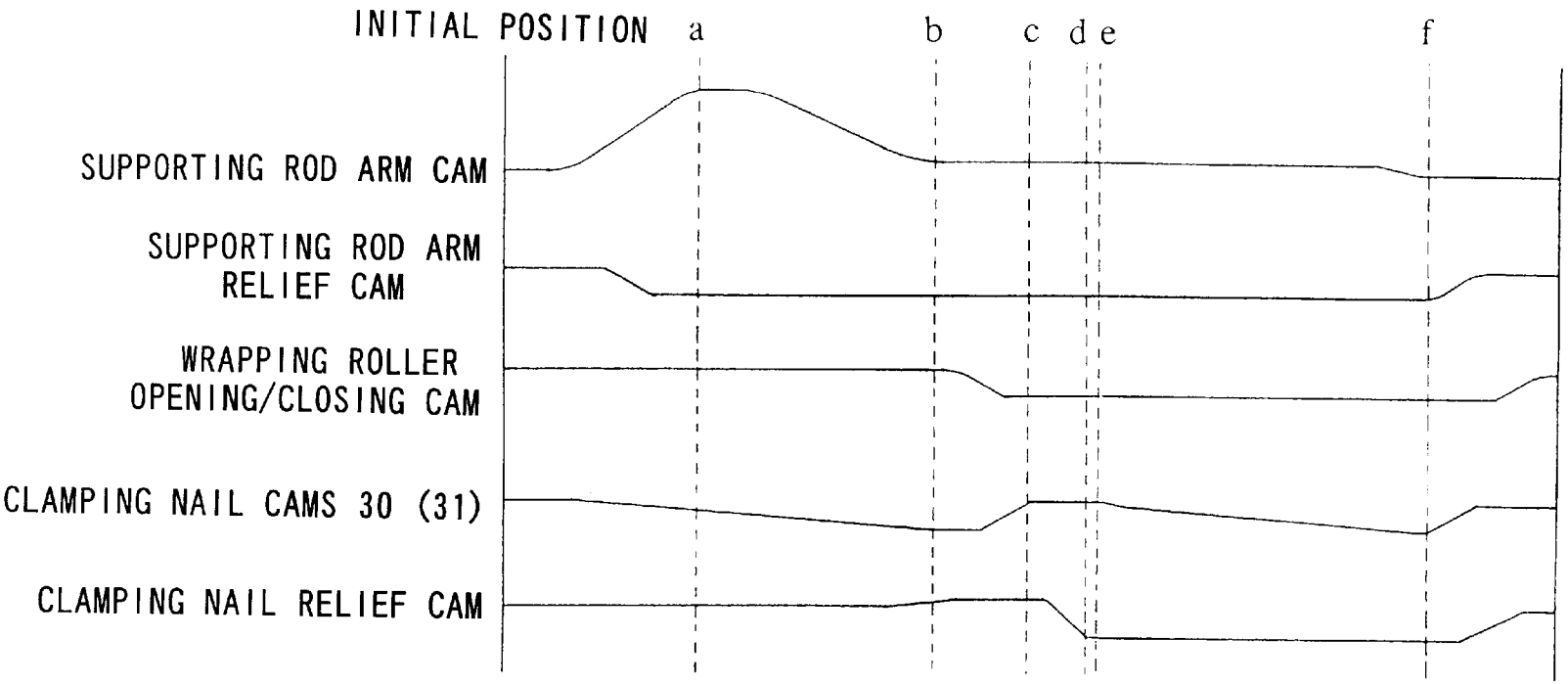
FIG. 4 is a cam diagram showing the operations of cams in the coin wrapping machine of FIG. 1.

FIG. 4 is a diagram showing the cam operations of the supporting rod arm cam, the supporting rod arm relief cam, the wrapping roller open/close cam, the clamping nail cams 30 and 31, and the clamping nail relief cam, which are driven by the cam motor 48 and control the operations of the supporting arm 16, the wrapping roller 11, and the clamping nails 18 and 19. In the cam diagram, as the cam motor 48 is rotated forward, the cams are moved toward the right. The left end represents the initial positions of the cams. As the cams are moved toward the right, the cams are accordingly operated. At the right end, one cycle of the operation is completed.

The cam diagram of the clamping nail cams 30 and 31 shows the cam movement of the clamping nail cam 30 for moving the upper clamping nail 18 in the vertical direction, and the cam movement of the clamping nail cam 31, which moves the lower clamping nail 19 symmetrically with the clamping nail cam 31 with respect to the horizontal line, is omitted.

With reference to the cam diagram of FIG. 4, the operations of the supporting rod arm 16, the wrapping roller 11 and the clamping nails 18 and 19 will be described.

The vertical movement of the supporting rod arm 16 is controlled by the supporting rod arm cam, and the horizontal movement of the supporting rod arm 16 is controlled by the supporting rod arm relief cam. At the initial position of the cam diagram, the supporting rod arm 16 separates the supporting rod 10 horizontally from the wrapping rollers 11 while disposing the supporting rod 10 at a lower withdrawn position. When the operation of the supporting rod arm 16 is started, the supporting rod 10 is disposed in the vertical direction at the center between the wrapping rollers 11 by the supporting rod arm relief cam while lifting the supporting rod 10 by the supporting rod arm cam. Then, at the position denoted as the reference numeral "a" in FIG. 4, the supporting rod 10 is disposed just below the shutter 8 under the stacking drum 6, and receives stacked coins 7 from the stacking drum 6 through the shutter 8.

Subsequently, from the position "a" in FIG. 4 to the position "b", the supporting rod 10 is lowered between the wrapping rollers 11 while supporting the underside of the stacked coins 7. Then, at the position "f" where all wrapping operations have been completed, the supporting rod 10 is lowered slightly by the operation of the supporting arm cam so that the supporting rod 10 is separated from the wrapped stack of coins 7A. The supporting rod 10 is then moved to the withdrawn position by the side of the wrapping rollers by means of the supporting arm relief cam, at which point one cycle of the operation of the wrapping system is completed.

Next, from the initial position of the cam diagram to the point "b" in FIG. 4, the three wrapping rollers 11 are brought separated from each other. From the point "b" in FIG. 4, which is the starting point of the wrapping operation when the supporting rod 10 disposes the stacked coins 7 between the wrapping rollers 11, to the point "c" in FIG. 4, the wrapping rollers 11 are moved inward toward the center of the stacked coins 7 (in the radial direction of the stacked coins 7). As a result, the stacked coins 7 are held by the wrapping rollers 11. After the point "f" at which point the wrapping operation is completed and the supporting rod arm 16 has been withdrawn, the wrapping rollers 11 are moved outward in the radial directions of the wrapped stack of coins 7A so that the wrapped stack of coins 7A are released and dropped. Thus, one cycle of the operation of the wrapping system is completed. In the operation, the wrapping paper 12 is fed into the space between the wrapping roller 11 and the stacked coins 7 before the stacked coins 7 are held by the wrapping roller 11. Specifically, at the point "b" in FIG. 4, which is the wrapping operation starting point from which the approach of the wrapping rollers 11 to the stacked coins 7 is started, the feeding of the wrapping paper 12 by the wrapping paper feed roller 17 is started.

The vertical operations of the clamping nails 18 and 19 are controlled by the clamping nail cams 30 and 31, whereas the horizontal operations of the clamping nails 18 and 19 are controlled by the clamping nail relief cams. Once the wrapping operation is started, at the point "c" in FIG. 4 at which the stacked coins 7 have been held by the wrapping rollers 11, the lower clamping nail 18 is disposed at the uppermost position, and the upper clamping nail 19 is disposed at the lowermost position. Between the points "c" and "d" in FIG. 4, the clamping nails 18 and 19 are moved by means of the clamping nail relief cams from their withdrawn positions, which are horizontally separated from the wrapping roller 11, to the separated positions where the clamping nails 18 and 19 are positioned above and below (and are separated from) the stacked coins 7. By means of the clamping nail cams 30 and 31 between the points "e" and "f", the upper and lower clamping nails 18 and 19 are brought close to each other so that they come in contact with the upper and lower surfaces of the stacked coins 7.

In one cycle of the operation shown in FIG. 4, the clamping nail cams 30 and 31 are formed so as to reciprocate the upper and lower clamping nails 18 and 19 once between the initial position of FIG. 4 and the point "c". This additional reciprocation prevents the stacked coins 7 on the supporting rod 10 from collapsing due to vibrations due to the backlash of a gear (not shown) in the cam mechanism 29.

The operation of the coin wrapping machine according to the embodiment will be described below.

When coins are dropped onto the rotary disc 1 and the rotary disc 1 is rotated, the falling coins are fed into the coin path 2 one by one by the centrifugal force produced by the rotation of the rotary disc 1, and are carried by the feed belt 3. While the coins are being carried on the coin path 2 by the feed belt 3, it is determined whether the denominations of the coins are the preset denomination. Coins other than the preset denomination are rejected, and the number of coins of the preset denomination are counted.

The coins fed through the coin path 2 are continuously supplied to the stacking drums 6 located at the end of the coin path 2. The coins are stacked by the stacking drums 6 which are rotated synchronously with the supply of the coins. When the desired number of coins are stacked by the stacking drums 6, the stacking drums 6 are further rotated so that the stacked coins 7 are transferred onto the shutter 8 located below the stacked drum 6.

On the other hand, after the desired number of coins has been counted in the coin path 2, the cam motor 48 is driven in the forward direction so that the supporting rod 10 is moved by the supporting rod arm cam and the supporting rod arm relief cam, and the supporting rod 10 is thus disposed just below the shutter 8 at the point "a" in FIG. 4.

At the point "a" in FIG. 4, the stacked coins 7 are transferred onto the supporting rod 10 by opening the shutter 8 on which the stacked coins 7 have been placed. The stacked coins 7 are carried to the wrapping position (at the point "b" in FIG. 4) between the wrapping rollers 11 in the wrapping section 9 by further rotating the supporting rod arm cam to lower the supporting rod 10.

The wrapping operation is started at the point "b" in FIG. 4. The stacked coins 7 fed in the wrapping section 9 are held by the three wrapping rollers 11, disposed around the stacked coins 7, by an operation of the wrapping roller opening/closing cam (at the point "c" in FIG. 4).

On the other hand, the upper and lower clamping nails 18 and 19 are disposed at their standby positions while maintaining the maximum distances from the wrapping rollers 11 in the horizontal direction. The clamping nails 18 and 19 are moved to the separated positions above and below the stacked coins 7 by means of the clamping nail relief cams (at the point "e" in FIG. 4).

At the wrapping operation starting point (the point "b" in FIG. 4), when the stacked coins 7 are placed at the predetermined position between the wrapping rollers 11, the wrapping operation instructing device 44 starts the wrapping paper feeding motor 46 and the wrapping motor 47. Thus, the wrapping paper 12 has been fed between the wrapping rollers 11 and the stacked coins 7 by the wrapping paper feed rollers 17, and the wrapping rollers 11 are rotated while holding the stacked coins 7. As the result, the wrapping paper 12 is wound around the cylindrical surfaces of the stacked coins 7. The wrapping paper feeding motor 46 is rotated to supply the normal amount of the wrapping paper 12 for wrapping the stacked coins 7A. Then, the wrapping paper feeding motor 46 is stopped while allowing the wrapping rollers 11 to rotate, so that the wrapping paper feed rollers 17 are suddenly stopped. Accordingly, the wrapping paper 12 is stretched between the wrapping rollers 11 and the wrapping paper feed rollers 17. The stretched portion is pressed against a cutter (not shown) provided between wrapping rollers 11 and the wrapping paper feed rollers 17 so that the paper is cut.

Figure 5B:
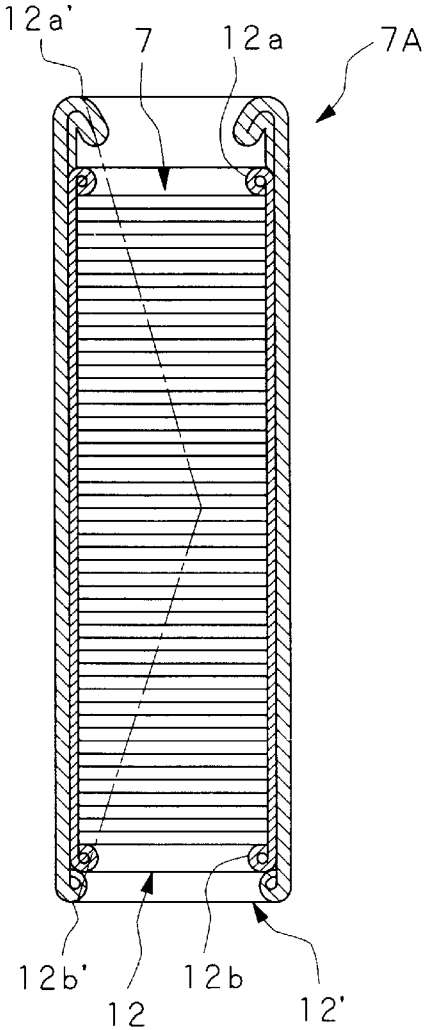
FIGS. 5A and 5B shows wrapped stacks of coins produced by the coin wrapping machine of FIG. 1.
Figure 5A:
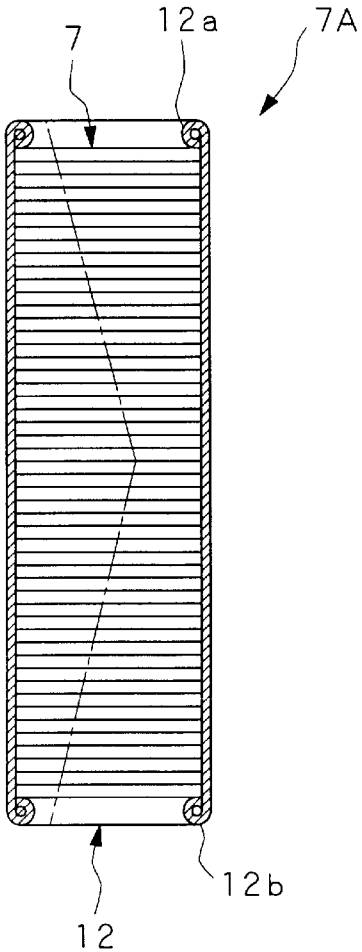

After the fed wrapping paper 12 has been completely wound around the cylindrical surface of the stacked coins 7, the clamping nails 18 and 19 are brought close to each other from the separated positions to the contact positions by the rotation of the cam motor 48, which is rotating in the forward direction, thereby clamping the upper and lower ends of the wrapping paper 12. Thus, the wrapping operation (the first wrapping operation) for the stacked coins 7 is completed, at which point the wrapped stack of coins 7A is completed (the point "f" in FIG. 4). In the wrapping operation, the clamping nails 18 and 19 are moved by the biasing force of the spring 28 so that they contact the upper and lower surfaces of the set of the stacked coins 7. As shown in FIG. 5A, the upper clamped portion 12*a* of the wrapping paper bent into a round shape by the clamping action so that the round shaped portion comes in contact with the upper surface of the stacked coins 7. In a manner similar to that operation, the lower clamping portion 12*b* of the wrapping paper 12 comes in contact with the lower surface of the set of the stacked coins 7.

In the coin wrapping machine of the embodiment, the distance moved by the upper and lower clamping nails 18 and 19 from the separated positions to the contact positions to clamp the wrapping paper 12 are measured as the amount of rotation of the pinion 25 by the rotary encoder 26 of the clamping nail driving mechanism 20. The distances of movement, measured at the end of the wrapping operation (the point "f" in FIG. 4), are stored in the RAM 40 of the control device 15, and it is determined whether the stacked coins have an insufficient or excess number of coins.

The stored movement data of the clamping nails 18 and 19 is converted into the height data of the stacked coins 7 by the stacked coin number determining device 43 in the CPU 42. That is, since the separated positions of the upper and lower clamping nails 18 and 19 are uniquely defined, the distance between the clamping nails 18, 19 at the separated positions is fixed. Thus, the height of the stacked coins 7 can be computed by subtracting the distance moved by the clamping nails 18 and 19, that is, the total of the movement of the upper clamping nail 18 and the movement of the lower clamping nail 19, from that fixed value.

The obtained height of the stacked coins 7 is compared with the normal height stored in the ROM 41, to thereby determine whether the number of coins in the stack of coins 7 is normal, or insufficient or excess.

If the stacked coin number determining device 43 determines that the number of the stacked coins 7 is normal, the upper and lower clamping nails 18 and 19 are moved to the withdrawn positions by means of the clamping nail relief cams, while being maintained at the separated positions, by continuously rotating the cam motor 48 in the forward direction. Simultaneously, after the supporting rod 10 has been disposed at a withdrawn position by means of the supporting rod arm cam and the supporting rod arm relief cam, the wrapping roller opening/closing cam is operated so that the wrapping rollers 11 are opened to release the wrapped stack of coins 7A, to thereby discharge the wrapped stack of coins 7A into a roll chute (not shown).

When the stacked coin number determining device 43 determines that the stacked coins 7 have an insufficient or excess number of coins, a signal, indicating that the stacked coins have an insufficient or excess number of coins, is sent to the wrapping paper multiple winding control device 54 at the wrapping operation completion point (at the point "f" in FIG. 4). Then, the wrapping paper multiple winding control device 54 directs the wrapping section 9 to perform the second wrapping operation.

That is, the wrapping paper multiple winding control device 54 reverses the direction of rotation of the cam motor 48 using the rotation direction switching device 45. The operation of reverse rotation of the cam motor 48 is continued to the point "b" in FIG. 4 where the clamping nails 18 and 19 are disposed at the separated positions so that the wrapping paper 12 can be reinserted. When the cam reaches the point "b" in FIG. 4, the direction of rotation of the cam motor 48 is switched to the forward direction, to start the second wrapping operation.

At the time of starting of the second wrapping operation (at the time of returning to the point "b" in FIG. 4) at which the operation of reverse rotation of the cam motor 48 is completed and the cam motor 48 is switched to the forward rotation, the wrapping paper multiple winding control device 54 directs the wrapping operation instructing device 44 to start the wrapping paper feeding motor 46 and the wrapping motor 47. The wrapping paper 12 is thus fed between the wrapping rollers 11 and the coins 7A, which have been wrapped in the first wrapping operation, by the wrapping paper feed rollers 17. Then, the wrapping rollers 11 are rotated while holding the wrapped stack of coins 7A. As a result, the second wrapping paper 12 is wound around the cylindrical surface of the wrapped stack of coins 7A. The wrapping paper feeding motor 46 is rotated to supply the normal amount of the wrapping paper 12 for wrapping the stacked coins. Then, the wrapping paper feeding motor 46 is stopped while allowing the wrapping rollers 11 to rotate, so that the wrapping paper feed rollers 17 are suddenly stopped. Accordingly, the wrapping paper 12 is stretched between the wrapping rollers 11 and the wrapping paper feed rollers 17. The stretched portion is pressed against a cutter (not shown) provided between wrapping rollers 11 and the wrapping paper feed rollers 17 so that the paper is cut.

At the time of starting the second wrapping operation (at the time of returning to the position "b" in FIG. 4) at which the operation of reverse rotation of the cam motor 48 is completed and the cam motor 48 is switched to the forward rotation, the wrapping paper multiple winding control device 54 energizes the solenoid 51 which has been demagnetized to make the stopper 50 protrude into the path of motion of the upper movable arm 36.

When the wrapping paper 12 fed by the second wrapping operation in completely wound around the cylindrical surface of the stacked coins 7, the clamping nails 18 and 19 are brought close to each other from the separated positions to the contact positions by the cam motor 48, which is rotating in the forward direction, thereby clamping the upper and lower ends of the wrapping paper 12. At that time, the upper clamping nail 18 is stopped at a predetermined stop position (above the position where the clamping nail 18 abuts against the upper surface of the stacked coins) where the movement of the upper movable arm 36 is restricted by abutting against the stopper 50. As a result, as shown in FIG. 5B, in the second wrapping operation, the upper clamped portion 12*a*' of a wrapping paper 12' is formed by the upper clamping nail 18 with the biasing force of the spring 28 at a predetermined position which is separated from the upper clamped portion 12*a* of the wrapping paper 12 formed in the first wrapping operation. In the second wrapping operation, the upper clamped portion 12*b*' of a wrapping paper 12' is formed by the lower clamping nail 19 with the biasing force of the spring 28 at a position nearest to the lower clamped portion 12*b* of the wrapping paper 12 formed in the first wrapping operation.

After the completion of the second wrapping operation (at the point "f" in FIG. 4), the upper and lower clamping nails 18 and 19 are moved to the withdrawn positions by means of the clamping nail relief cams, while separating the clamping nails 18 and 19, by maintaining the rotation of the cam motor 48 in the forward direction. At the same time, the supporting rod 10 is moved to the withdrawn position by means of the supporting rod arm cam and the supporting rod arm relief cam, and the wrapping roller opening/closing cam is operated to separate the wrapping rollers 11 which are holding the wrapped stack of coins 7A with an insufficient or excess number of coins, thereby releasing the wrapped stack of coins 7A (after the point "f" in FIG. 4). The wrapped stack of coins 7A with an insufficient or excess number of coins are discharged into a reject box (not shown), which is separated from the roll chute for receiving the wrapped stack of coins 7A with the normal number of coins.

After the completion of the second wrapping operation, instead of discharging the wrapped stacks of coins 7A with an insufficient or excess number of coins, third and subsequent wrapping operations may be performed if necessary.

As described above, according to the coin wrapping machine of the embodiment, when an insufficient or excess number of coins in a wrapped stack of coins 7A is detected by the stacked coin number determining device 43, the wrapping paper multiple winding control device 54 directs the wrapping section 9 to perform one or more wrapping operations for the wrapped stack of coins 7A. In the second and subsequent wrapping operations, the distance moved by the upper clamping nail 18 is shorter than that in the first wrapping operation. Therefore, the clamping action is stopped incompletely so that an incomplete clamped portion is intentionally produced at the clamped edge portions of the wrapped stack of coins 7A wrapped twice or more. That is, as shown in FIG. 5B, in the second wrapping operation, the upper clamped portion 12*a*' of a wrapping paper 12' is formed by the upper clamping nail 18 with the biasing force of the spring 28 at a position separated from the upper clamped portion 12*a* of the wrapping paper 12 which has been formed in the first wrapping operation. In the second wrapping operation, the lower clamped portion 12*b*' of a wrapping paper 12' is formed by the lower clamping nail 19 with the biasing force of the spring 28 at a position nearest to the lower clamped portion 12*b* of the wrapping paper 12 which has been formed in the first wrapping operation. Thus, a distinct clamping failure can be formed at the upper portion. Accordingly, the wrapped stacks of coins 7A with an insufficient or excess number of coins can be visually distinguished from the normal wrapped stack of coins 7A by wrapping paper 12' which has been incompletely clamped and has been wrapped more times than usual.

Therefore, the wrapped stacks of coins 7A with the insufficient or excess number of coins, which are mixed with the normal wrapped stacks of coins 7A, can be clearly distinguished from the normal stacks of coins.

Further, because the stopper 50 and the solenoid 51 limits the distance moved by the upper clamping nail 18 to be shorter than that in the first wrapping operation, the clamping operation is stopped incompletely, and a distinct incompletely clamped portion can be produced at the upper clamped portion of the coins 7A wrapped twice or more.

Thus, the distance moved by the upper clamping nail 18 can be decreased by the simple configuration.

After the completion of the second or higher wrapping operation for the wrapped stacks of coins, the wrapped papers become thicker than films. Accordingly, the clamping portion is difficult to bent into a round shape with many layers. Additionally, as the diameter of the coins decreases, it becomes difficult to bent the clam ping portion into a round shape. Accordingly, the abnormally wrapped stacks of coins can be easily distinguished from normally wrapped stacks of coins. Further, even when the wrapping material is a film such as a stretched film, the film can be bent into a round shape with many layers because the film is thinner than a paper. Since a portion which has been clamped second or more times is elongated, the abnormally wrapped stacks of coins can be easily distinguished from normally wrapped stacks of coins.

In the above-described embodiment, the stopper 50 and the solenoid 51 are provided for the upper movable arm 36, and the movement of the upper clamping nail 18 is mechanically limited because the stopper 50 abuts against the upper movable arm 36, when an insufficient or excess number of coins is detected. The stopper 50, and the solenoid 51 may be provided for the lower movable arm 37, and the movement of the lower clamping nail 19 may be mechanically limited because the stopper 50 abuts against the lower movable arm 37, when an insufficient or excess number of coins is detected.

Figure 6B:
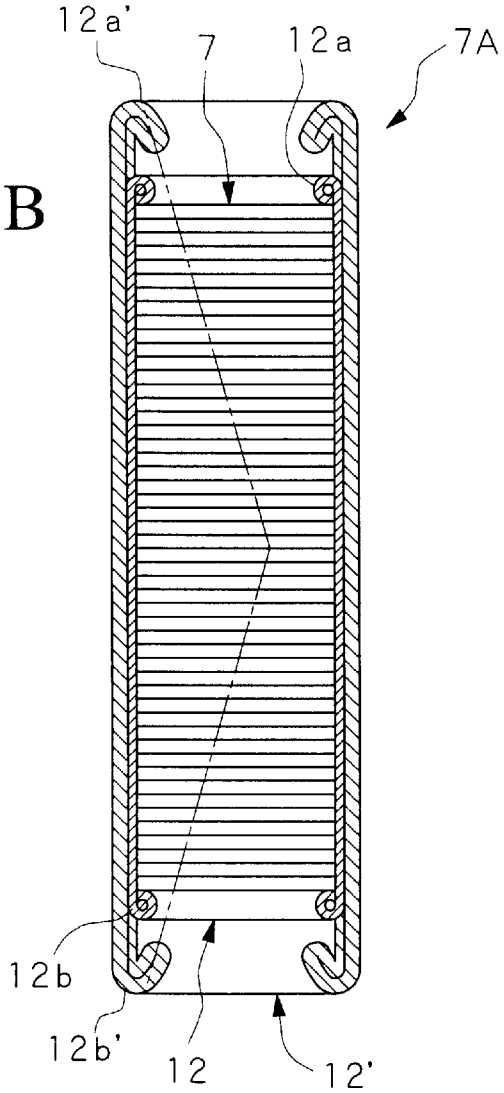
Figure 6A:
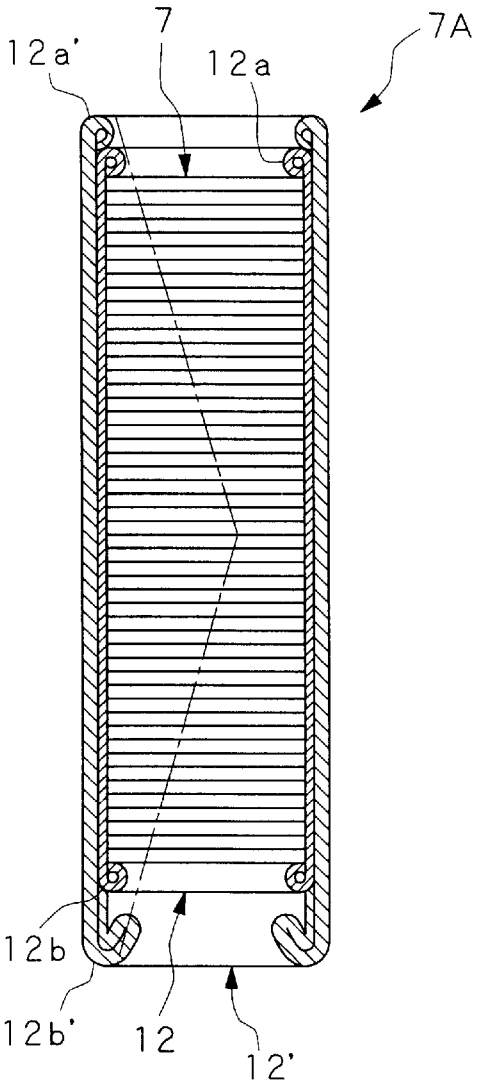
FIG. 6A shows a normal wrapped stack of coins.

In this case, as shown in FIG. 6A, the lower clamp ed portion 12*b*' of a wrapping paper 12' is formed by the lower clamping nail 19 with the biasing force of the spring 28 at a predetermined position separated from the lower clamped portion 12*b* of the wrapping paper 12 which has been formed in the first wrapping operation. The upper clamped portion 12*a*' of a wrapping paper 12' is formed by the upper clamping nail 18 with the biasing force of the spring 28 at a position nearest to the upper clamped portion 12*a* of the wrapping paper 12 which has been formed in the first wrapping operation. Thus, the distinct incompletely clamped portion can be formed on the lower side.

Further, the stoppers 50 and the solenoids 51 may be provided for both the upper movable arm 36 and the lower movable arm 37. The movements of the upper clamping nail 18 and the lower clamping nail 19 may be mechanically limited because the stoppers 50 abut both the upper movable arm 36 and the lower movable arm 37 when the insufficient or excess number of coins is detected.

In this case, as shown in FIG. 6B, the upper clamped portion 12*a*' and the lower clamped portion 12*b*' of a wrapping paper 12' is formed by the upper clamping nail 18 and the lower clamping nail 19 with the biasing force of the spring 28 at predetermined positions separated from the upper clamped portion 12*a* and the lower clamped portion 12*b* of the wrapping paper 12 which have been formed in the first wrapping operation. Thus, the distinct incompletely clamped portion may be formed on both the upper and lower ends.

The movements of the clamping nails 18 and 19 may not be restricted, and only the second or more wrapping operation may be performed. In this case, the wrapped stacks of coins 7A with an insufficient or excess number of coins can be visually distinguished from the normal wrapped stack of coins 7A by the wrapping papers 12 which have been incompletely clamped and has been wrapped more times than usual. Thus, even if the abnormally wrapped stacks coins 7A with an insufficient or excess number of coins are mixed with the normally wrapped stacks of coins 7A, the user can immediately take the necessary action (e.g., remove the abnormally wrapped stacks of coins).

Further, as the member which limits the movement of the clamping nails 18 and 19 in the second or higher wrapping operation, a link or a lever may be used instead of the above-mentioned stopper 50. A motor or the like may be used instead of the solenoid 51.

As described above, according to the first aspect of the present invention, when the insufficient or excess number of coins is detected by an insufficient/excess number detecting device, the wrapping paper multiple winding control device directs the wrapping paper winding and clamping device to perform the wrapping operation twice or more for the wrapped stack of coins. The wrapped stacks of coins with the insufficient or excess number of coins can be visually distinguished from the normally wrapped stacks of coins.

Therefore, even if an abnormally wrapped stack of coins with an insufficient or excess number of coins is mixed with the normally wrapped stacks of coins, the user can immediately take the necessary action.

According to the second aspect of the present invention, when an insufficient or excess number of coins is detected by the insufficient/excess number detecting device, the wrapping paper multiple winding control device directs the wrapping paper winding and clamping device to perform the wrapping operation twice or more for the wrapped stack of coins. In the second and subsequent wrapping operations, the distance moved by the upper clamping nail is shorter than that in the first wrapping operation. Therefore, the clamping action is stopped incompletely so that an incompletely clamped portion is intentionally produced at the clamped edge portions of doubly or more wrapped stack of coins. Accordingly, wrapped stacks of coins with an insufficient or excess number of coins can be visually distinguished from the normally wrapped stacks of coins by the condition of the wrapping paper, which has been incompletely clamped and has been wrapped more times than usual.

Therefore, even if abnormally wrapped stacks of coins with an insufficient or excess number of coins are mixed with the normally wrapped stacks of coins, the abnormally wrapped stacks of coins can be distinguished from the normally wrapped stacks of coins.

According to the third aspect of the present invention, the limiting device limits the distance moved by the upper or lower clamping nail to be shorter than that in the first wrapping operation. Therefore, the clamping action is stopped incompletely, and a distinct incompletely clamped portion can be produced at the upper or lower clamped portion of the doubly or more wrapped stack of coins.

Thus, the distance moved by the upper clamping nail 18 can be decreased by a simple configuration.

According to the fourth aspect of the present invention, the limiting device limits the distance moved by the upper and lower clamping nails to be shorter than that in the first wrapping operation. Therefore, the clamping action is stopped incompletely, and distinct incompletely clamped portions can be produced at both the ends of the stack of coins wrapped twice or more.

Thus, the distance moved by the upper clamping nail 18 can be decreased by a simple configuration. Further, because incompletely clamped portions are formed at both the ends of the stack of coins, the incompletely clamped portions are distinct.

What is claimed is:

1. A coin wrapping method comprising:

feeding a plurality of coins one by one;

stacking the fed coins;

performing a wrapping operation, using a wrapping machine, to produce a wrapped stack of coins, including winding a wrapping paper around the circumference of the stacked coins and clamping the wrapping paper with a pair of upper and lower clamping nails of said wrapping machine by moving the respective nails downwardly and upwardly;

detecting whether the number of the coins wrapped in a stack is less than or greater than a predetermined number of coins; and performing the wrapping operation twice or more for the wrapped stack of coins when a shortage or an excess number of coins is detected.

2. The coin wrapping method according to claim 1, further comprising producing a partly clamped portion by adjusting the distance moved by the clamping nails in the second and subsequent wrapping operations to be shorter than that in the first wrapping operation.

3. The coin wrapping method according to claim 2, further comprising limiting the movement of at least one of the upper and lower clamping nails in the second and subsequent wrapping operations to be shorter than that in the first wrapping operation.

4. The coin wrapping method according to claim 2, further comprising limiting the movements of both the upper and lower clamping nails in the second and subsequent wrapping operations to be shorter than that in the first wrapping operation.

5. A coin wrapping machine comprising:

a coin feeding means for feeding a plurality of coins one by one;

a stacking means for stacking the fed coins;

a wrapping paper winding and clamping means for performing a wrapping operation to produce wrapped stacks of coins by winding a wrapping paper around the circumference of the stacked coins, and clamping the wrapping paper by a pair of upper and lower clamping nails by moving the respective nails downwardly and upwardly;

a shortage/excess number detecting means for detecting whether the number of the coins wrapped in a stack has a shortage or an excess; and a wrapping paper multiple winding control means for directing the wrapping paper winding and clamping device to perform the wrapping operation twice or more for the wrapped stack of coins when a shortage or an excess number of coins is detected by the shortage/excess number detecting means.

6. The coin wrapping machine according to claim 1, wherein the wrapping paper multiple winding control means produces a partially clamped portion by adjusting the distance moved by the clamping nails in the second and subsequent wrapping operations to be shorter than that in the first wrapping operation.

7. The coin wrapping machine according to claim 2, wherein the wrapping paper multiple winding control means has a limiting device for limiting the movement of at least one of the upper and lower clamping nails in the second and subsequent wrapping operations to be shorter than that in the first wrapping operation.

8. The coin wrapping machine according to claim 2, wherein the wrapping paper multiple winding control means has a limiting device for limiting the movements of both the upper and lower clamping nails in the second and subsequent wrapping operations to be shorter than that in the first wrapping operation.

* * * * *